US011571792B2

(12) United States Patent
Yasutomi et al.

(10) Patent No.: US 11,571,792 B2
(45) Date of Patent: Feb. 7, 2023

(54) DRIVER

(71) Applicant: KOKI HOLDINGS CO., LTD., Tokyo (JP)

(72) Inventors: Toshinori Yasutomi, Ibaraki (JP); Hironori Mashiko, Ibaraki (JP); Yuki Mitoma, Ibaraki (JP)

(73) Assignee: KOKI HOLDINGS CO., LTD., Tokyo (JP)

( * ) Notice: Subject to any disclaimer, the term of this patent is extended or adjusted under 35 U.S.C. 154(b) by 0 days.

(21) Appl. No.: 16/635,289

(22) PCT Filed: Jun. 29, 2018

(86) PCT No.: PCT/JP2018/024853
§ 371 (c)(1),
(2) Date: Jan. 30, 2020

(87) PCT Pub. No.: WO2019/026502
PCT Pub. Date: Feb. 7, 2019

(65) Prior Publication Data

US 2020/0391364 A1 Dec. 17, 2020

(30) Foreign Application Priority Data

Jul. 31, 2017 (JP) ..... JP2017-148496

(51) Int. Cl.
*B25C 1/00* (2006.01)
*B25C 1/06* (2006.01)

(52) U.S. Cl.
CPC ..... *B25C 1/008* (2013.01); *B25C 1/06* (2013.01)

(58) Field of Classification Search
CPC ..... B25C 1/008; B25C 1/06; B23Q 17/2241
See application file for complete search history.

(56) References Cited

U.S. PATENT DOCUMENTS 5,752,643 A * 5/1998 MacVicar ..... B25C 1/008 227/8
6,971,567 B1 * 12/2005 Cannaliato ..... B25C 1/06 173/205

(Continued)

FOREIGN PATENT DOCUMENTS

CN 102284934 A 12/2011
JP 54-074384 U 5/1979

(Continued)

OTHER PUBLICATIONS

Extended European Search Report issued in corresponding European Patent Application No. 18841290.2-1017, dated Mar. 29, 2021.

(Continued)

*Primary Examiner* — Anna K Kinsaul
*Assistant Examiner* — Luis G Del Valle
(74) *Attorney, Agent, or Firm* — McDermott Will & Emery LLP

(57) ABSTRACT

A driver capable of achieving favorable workmanship at the time of driving of a fastener into a workpiece to be driven is provided. In a driver having a striking unit; a first bias unit causing the striking unit to strike a fastener; a first operational unit and a second operational unit, and a control unit moving the striking unit in a first direction, the control unit can select a first driving mode, a second driving mode and a limitation mode, the first driving mode moving the striking unit in the first direction so that the fastener is struck when the first operational unit is operated after the second operational unit is pressed against the workpiece to be driven, the second driving mode moving the striking unit in the first direction so that the fastener is struck when the control unit detects the operation of the first operational unit and the pressing of the second operational unit against the workpiece to be driven, and the limitation mode limiting the (Continued)

second driving mode on the basis of a movement state of the striking unit.

12 Claims, 7 Drawing Sheets

(56) References Cited

U.S. PATENT DOCUMENTS

| | | | | |
|---|---|---|---|---|
| 8,875,969 | B2 * | 11/2014 | Pedicini | B25C 1/04 227/8 |
| 9,050,712 | B2 * | 6/2015 | Campbell | B25C 1/047 |
| 2002/0108474 | A1 | 8/2002 | Adams | |
| 2002/0185514 | A1 | 12/2002 | Adams et al. | |
| 2005/0040206 | A1 | 2/2005 | Adams et al. | |
| 2005/0217875 | A1 * | 10/2005 | Forster | B25C 1/06 173/1 |
| 2009/0194574 | A1 | 8/2009 | Shima et al. | |
| 2010/0116863 | A1 | 5/2010 | Suda | |
| 2011/0303428 | A1 * | 12/2011 | Roth | B25C 1/008 173/1 |
| 2014/0069671 | A1 * | 3/2014 | Leimbach | B25C 1/041 173/1 |
| 2015/0375381 | A1 * | 12/2015 | Tanji | B25C 1/06 227/146 |
| 2017/0190037 | A1 * | 7/2017 | Sato | B25C 1/06 |
| 2018/0036870 | A1 * | 2/2018 | Komazaki | B25C 1/047 |

FOREIGN PATENT DOCUMENTS

| | | | | |
|---|---|---|---|---|
| JP | 2004-536542 | A | 12/2004 | |
| JP | 2009-006446 | A | 1/2009 | |
| JP | 2009-184050 | A | 8/2009 | |
| JP | 2013-233609 | A | 11/2013 | |
| JP | 2013233609 | A * | 11/2013 | B25C 1/04 |
| JP | 5424105 | B2 | 2/2014 | |
| JP | 2016-190277 | A | 11/2016 | |
| WO | 02/051592 | A1 | 7/2002 | |

OTHER PUBLICATIONS

International Search Report issued in corresponding International Patent Application No. PCT/JP2018/024853, dated Sep. 18, 2018, with English translation.

Office Action issued from corresponding Chinese Application No. 201880052047.9 dated Aug. 10, 2022, with English Translation (20 pages).

* cited by examiner

10: DRIVER
12: STRIKING UNIT
13: FIRST BIAS UNIT
58: FASTENER
66: FIRST OPERATIONAL UNIT
68: SECOND OPERATIONAL UNIT
B1: FIRST DIRECTION

DRIVER

CROSS REFERENCE TO RELATED APPLICATIONS

This application is the U.S. National Phase under 35 U.S.C. § 371 of International Patent Application No. PCT/JP2018/024853, filed on Jun. 29, 2018, which claims the benefits of Japanese Patent Application No. 2017-148496, filed on Jul. 31, 2017 the entire contents of which are hereby incorporated by reference.

TECHNICAL FIELD

The present invention relates to a driver that moves a striking unit to cause the striking unit to strike a fastener.

BACKGROUND ART

Conventionally, a driver that moves a striking unit to cause the striking unit to strike a fastener has been known, and such a driver is described in a Patent Document 1. The driver that is described in the Patent Document 1 has a housing, the striking unit, a motor, a spring, a compression release mechanism and a magazine. The motor is housed in the housing, and the striking unit has a plunger and a blade fixed to the plunger. The plunger can reciprocate inside the housing. The spring biases the plunger in a direction of the striking of the fastener. The housing has a handle and a battery retainer unit. A controller is arranged inside the housing. A trigger is arranged in the handle. When the trigger is operated, a trigger switch is turned ON. A battery is attached/detached to/from the battery retainer unit. A nose is arranged in the housing, and the fastener inside the magazine is fed to the nose. A push lever is arranged in the nose. When the push lever is pressed against a "workpiece to be driven", a push switch is turned ON. The battery, the trigger switch, the push switch and the motor are connected to the controller.

When an operator presses the push lever against the workpiece to be driven while operating the trigger at the time of stop of the striking unit at an idle position, power is supplied from the battery to the motor, so that the motor rotates. The compression release mechanism engages with the striking unit, and the striking unit is moved toward a top dead point by a torque of the motor. By the movement of the striking unit, the spring is compressed. When the striking unit arrives at the top dead point, the compression release mechanism is released from the striking unit, and the striking unit is moved toward a bottom dead point by a force of the spring. By the movement of the striking unit, the fastener is struck by an end of the blade, and the fastener is driven into the workpiece to be driven. After the blade strikes the fastener, the compression release mechanism is engaged with the striking unit by the rotation of the motor, and the striking unit arrives at the idle position, and then, the motor stops. The Patent Document 1 discloses that the operator performs a continuous-shot driving operation as one example of the driving operation by pressing the push lever against the workpiece to be driven while pulling the trigger.

RELATED ART DOCUMENT

Patent Document

Patent Document 1: Japanese Patent No. 5424105

SUMMARY OF THE INVENTION

Problems to be Solved by the Invention

However, the driver described in the Patent Document 1 possibly fails to favorably maintain workmanship at the time of the striking of the fastener by the operation of the driver into the workpiece to be driven, if operational time taken for the striking of the fastener operated by the striking unit changes.

An object of the present invention is to provide a driver capable of favorably maintaining the workmanship at the time of the striking of the fastener into the workpiece to be driven.

Means for Solving the Problems

A driver of one embodiment includes: a striking unit being movable in a first direction and a second direction that is opposite to the first direction; a first bias unit moving the striking unit in the first direction to cause the striking unit to strike a fastener; a first operational unit operated by an operator; a second operational unit pressed against the workpiece to be driven into which the fastener is driven; and a control unit causing the first bias unit to move the striking unit in the first direction when detecting the operation of the first operational unit and the pressing of the second operational unit against the workpiece to be driven, and the control unit can select a first driving mode, a second driving mode and a limitation mode, the first driving mode causing the first bias unit to move the striking unit in the first direction to strike the fastener when the control unit detects the operation of the first operational unit after the pressing of the second operational unit against the workpiece to be driven, the second driving mode causing the first bias unit to move the striking unit in the first direction to strike the fastener when the control unit detects the operation of the first operational unit and the pressing of the second operational unit against the workpiece to be driven, and the limitation mode limiting the second driving mode on the basis of a movement state of the striking unit that strikes the fastener.

Effects of the Invention

A driver of one embodiment can favorably maintain workmanship at the time of driving of a fastener into a workpiece to be driven.

BRIEF DESCRIPTIONS OF THE DRAWINGS

BEST MODE FOR CARRYING OUT THE INVENTION

A driver according to one embodiment of the present invention will be described with reference to the drawings.

Figure 1:
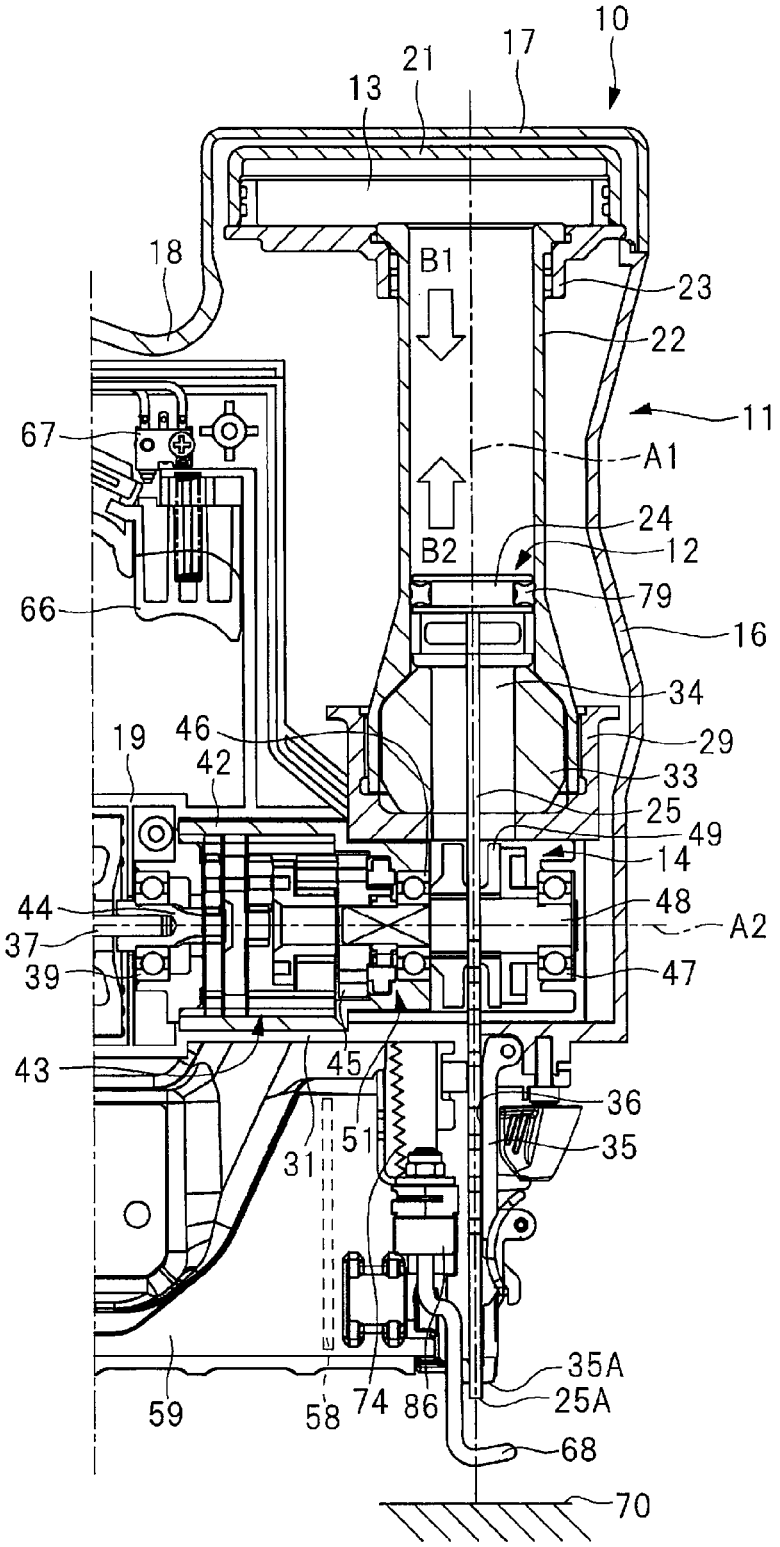
FIG. 1 is a side cross-sectional view of a part including a striking unit in a driver according to one embodiment of the present invention.
Figure 2:
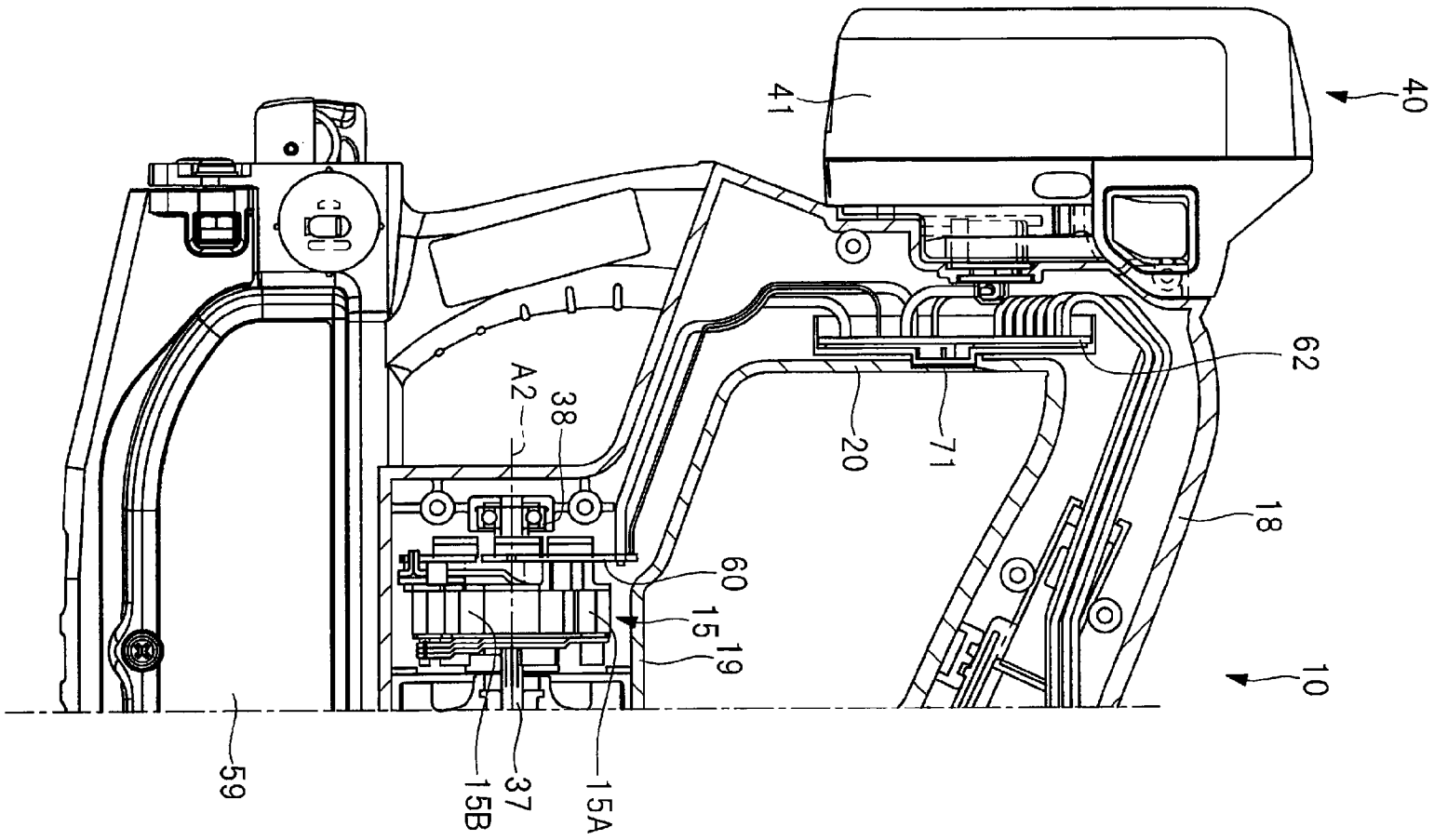
FIG. 2 is a side cross-sectional view of a part including a storage battery in the driver.
Figure 3:
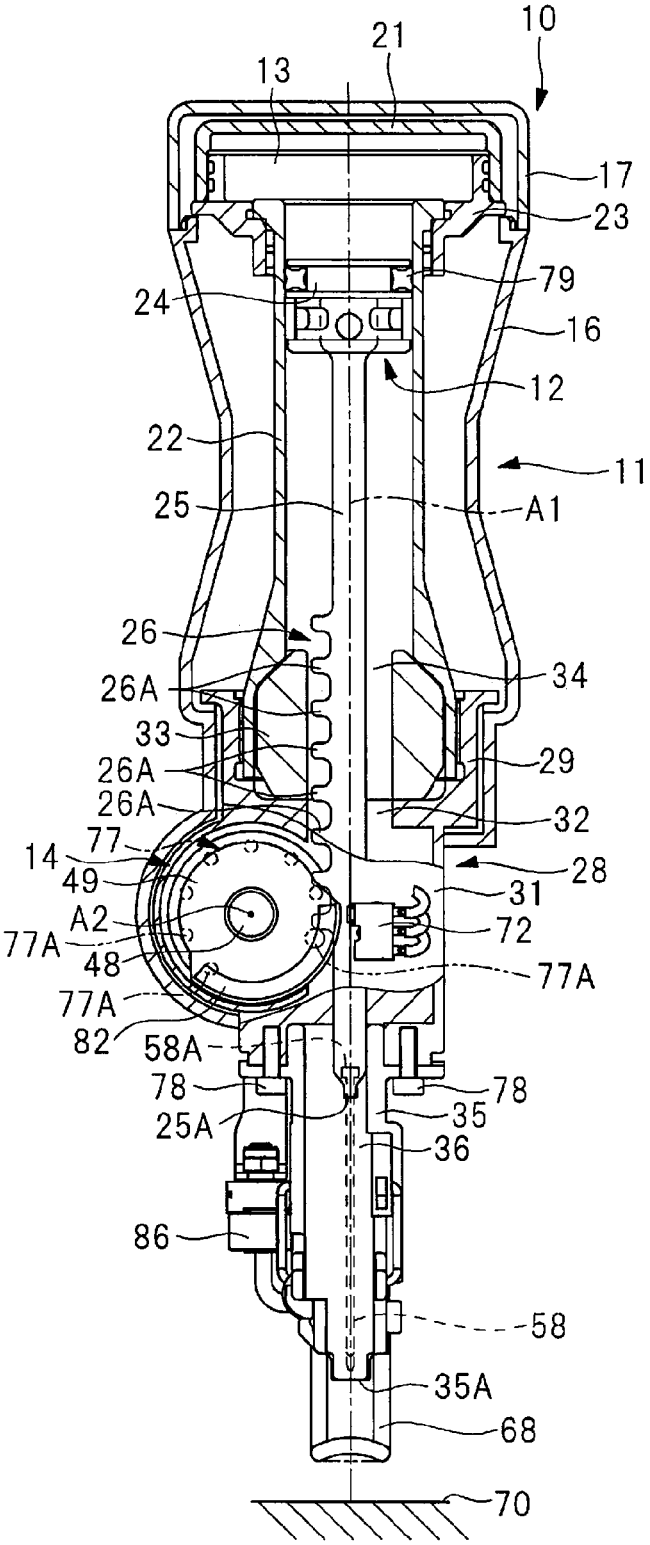
FIG. 3 is a front cross-sectional view of the driver.

A driver 10 is shown in FIGS. 1, 2 and 3. The driver 10 has a housing 11, a striking unit 12, a pressure chamber 13, a power transmission mechanism 14 and an electric motor 15. The housing 11 is an outer package element, and the striking unit 12 is arranged from inside of the housing 11 to outside. The pressure chamber 13 moves the striking unit 12 in a first direction "B1" from a top dead point toward a bottom dead point. The power transmission mechanism 14 moves the striking unit 12 in a second direction "B2" that is opposite to the first direction. The electric motor 15 is arranged inside the housing 11.

The housing 11 has a tubular main body 16, a cover 17 closing an opening of the main body 16, a handle 18 and a motor storage 19 continuously formed from the main body 16, and a connecting unit 20 connecting the handle 18 and the motor storage 19. A pressure reservoir 21 and a cylinder 22 are arranged inside the housing 11, and a ring connecting tool 23 connects the pressure reservoir 21 and the cylinder 22. The pressure chamber 13 is formed inside the pressure reservoir 21.

The striking unit 12 has a piston 24 arranged inside the cylinder 22 so as to be movable, and a driver blade 25 fixed to the piston 24. The piston 24 is movable in a direction of a center line "A1" of the cylinder 22. The direction of the center line A1 is parallel to the first direction B1 and the second direction B2. A sealing member 79 is attached to an outer circumference of the piston 24, and the sealing member 79 forms a sealing surface when being in contact with an inner surface of the cylinder 22. The sealing member 79 ensures airtightness of the pressure chamber 13. The sealing member 79 is made of a synthetic resin.

Compressible gas is encapsulated in the pressure chamber 13. As the gas encapsulated in the pressure chamber 13, not only air but also inert gas such as nitrogen gas or a noble gas or others can be used. In the present disclose, an example of encapsulation of dry air in the pressure chamber 13 will be described. The driver blade 25 is made of metal or resin. As shown in FIG. 3, a rack 26 is arranged along a longitudinal direction of the driver blade 25. The rack 26 has a plurality of convex portions 26A. The plurality of convex portions 26A are arranged in the direction of the center line A1 so as to have a certain gap therebetween.

As shown in FIG. 3, a holder 28 is arranged from an inner side of the main body 16 to outside. As the holder 28, the one made of an aluminum alloy, the one made of a magnesium alloy, the one made of a synthetic resin having high stiffness or others is suitable. The holder 28 has a tubular load receiving unit 29 and a tale unit 31 continuously formed from the load receiving unit 29. The tale unit 31 is continuously formed from the motor storage 19.

The load receiving unit 29 is arranged inside the main body 16, and the load receiving unit 29 has a shaft hole 32. A bumper 33 is arranged inside the load receiving unit 29. The bumper 33 is made of synthetic rubber or synthetic resin. The bumper 33 has a shaft hole 34. Both the shaft holes 32 and 34 are arranged so as to center the center line A1, and the driver blade 25 is movable inside the shaft holes 32 and 34 in the direction of the center line A1. The nose unit 35 is fixed to the tale unit 31 by using a screw member 78, and the nose unit 35 has an injection path 36. The injection path 36 is a space or a passage, and the driver blade 25 is movable inside the injection path 36 in the direction of the center line A1.

The electric motor 15 is arranged inside the motor storage 19. The electric motor 15 has a stator 15A that does not rotate with respect to the motor storage 19, a rotor 15B that is rotatable inside the motor storage 19, and a motor shaft 37 attached with the rotor 15B. The stator 15A has an electric-conduction coil, and the rotor 15B has a permanent magnet. The electric-conduction coil includes three coils corresponding to three phases, that is, a U phase, a V phase and a W phase. The electric motor 15 is a brushless motor. The electric conduction is generated in the coil to form a rotating magnetic field, so that the rotor 15B rotates.

The motor shaft 37 is supported so as to be rotatable by bearings 38 and 39. The motor shaft 37 is rotatable around an axis line A2. As shown in FIG. 2, a storage battery 40 that is detachable from the connecting unit 20 is arranged, and the storage battery 40 supplies the power to the stator 15A of the electric motor 15.

The storage battery 40 has a package case 41 and a battery cell housed in the package case 41. The battery cell is a secondary battery that is chargeable and dischargeable. As the battery cell, any of a lithium-ion battery, a nickel-hydrogen battery, a lithium-ion polymer battery and a nickel-cadmium battery can be used. The storage battery 40 is a direct-current power supply. A first terminal is arranged inside the package case 41, and the first terminal is connected to the battery cell. A second terminal is fixed to the connecting unit 20. When the storage battery 40 is attached to the connecting unit 20, the first terminal and the second terminal are connected so as to generate the electric conduction.

As shown in FIG. 1, a gear case 42 is arranged inside the tale unit 31, and a speed reducer 43 is arranged inside the gear case 42. The speed reducer 43 has an input member 44, an output member 45 and three pairs of planetary gear mechanisms. The input member 44 is fixed to the motor shaft 37. The input member 44 and the output member 45 are rotatable around the axis line A2. A torque of the motor shaft 37 is transmitted to the output member 45 through the input member 44. The speed reducer 43 reduces a rotating speed of the output member 45 relative to the input member 44.

The power transmission mechanism 14 is arranged inside the main body 16. The power transmission mechanism 14 has a pin wheel shaft 48, a pin wheel 49 fixed to the pin wheel shaft 48 and a pinion 77 arranged in the pin wheel 49. The pin wheel shaft 48 is supported so as to be rotatable by bearings 46 and 47. The pinion 77 has a plurality of pins 77A arranged so as to have a gap therebetween in a circumferential direction of the pin wheel 49. The number of the convex portions 26A configuring the rack 26 and the number of pins 77A configuring the pinion 77 are the same as each other. The power transmission mechanism 14 converts a torque of the pin wheel 49 into a moving force of the striking unit 12.

A rotation control mechanism 51 is arranged inside the gear case 42. The rotation control mechanism 51 is arranged in a power transmission path between the speed reducer 43 and the pin wheel 49. The rotation control mechanism 51 transmits a torque of the output member 45 to the pin wheel 48 regardless of a rotational direction of the output member 45. And, the rotation control mechanism 51 prevents the pin wheel shaft 48 from being rotated by the force transmitted from the driver blade 25.

A magazine 59 that houses a nail 58 is arranged, and the magazine 59 is supported by the nose unit 35 and the connecting unit 20. The magazine 59 has a feeding mechanism that supplies the nail 58 to the injection path 36.

Figure 4:
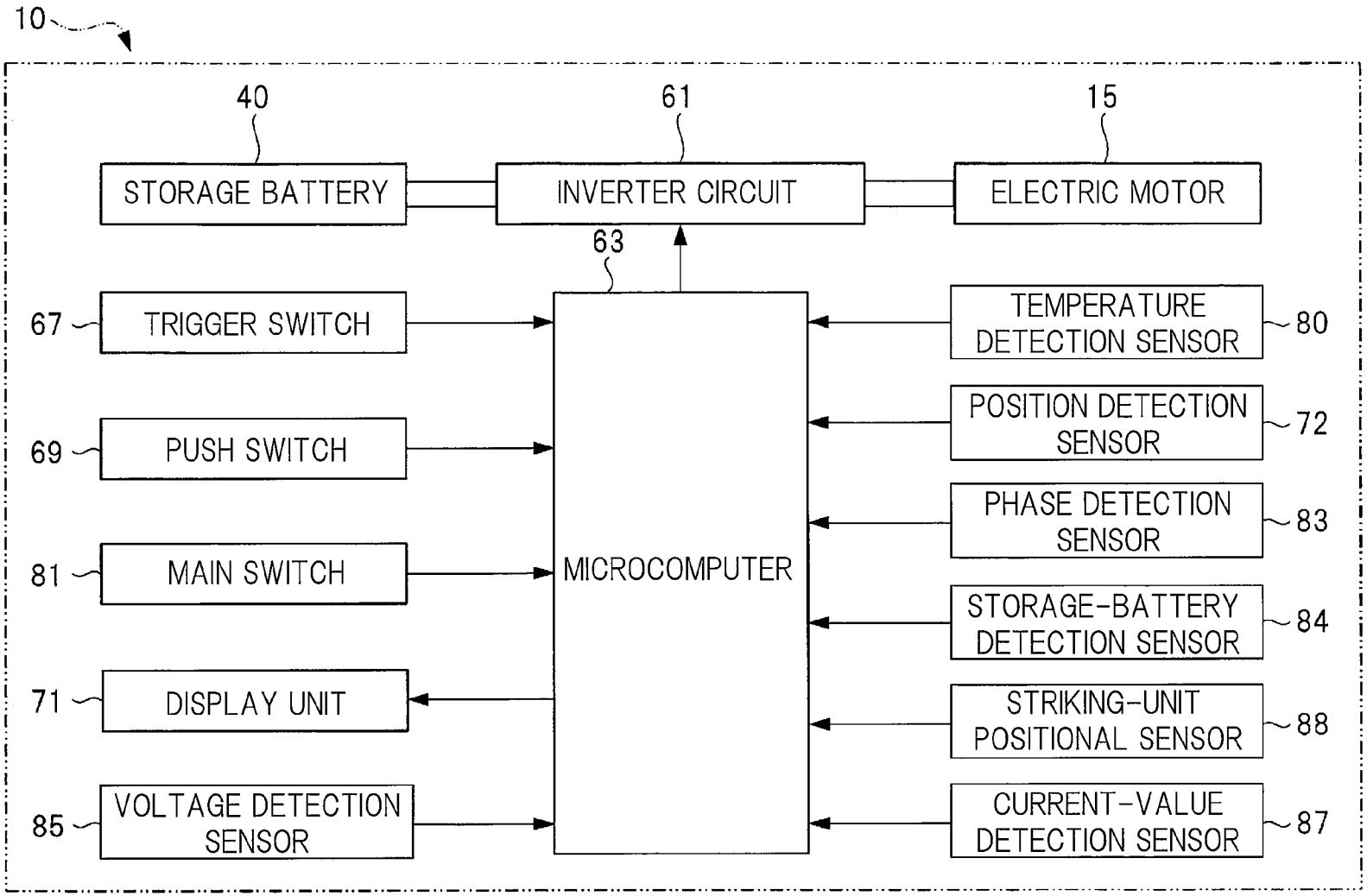
FIG. 4 is a block diagram showing a control system of the driver.

A motor substrate 60 is arranged inside the motor storage 19, and an inverter circuit 61 shown in FIG. 4 is arranged in the motor substrate 60. The inverter circuit 61 has a plurality of switching elements, and the plurality of switching elements can be independently turned ON and OFF.

As shown in FIG. 2, a control substrate 62 is arranged inside the connecting unit 20, and a microcomputer 63 shown in FIG. 4 is arranged in the control substrate 62. The microcomputer 63 has an input port, an output port, a central processing unit, a memory unit and a timer. The microcomputer 63 is connected to the second terminal and the inverter circuit 61.

As shown in FIG. 1, a trigger 66 is arranged in the handle 18. The trigger 66 is operated by the operator. A trigger switch 67 is arranged inside the handle 18, and the trigger switch 67 is turned ON when an operational force is applied to the trigger 66 or turned OFF when the operational force applied to the trigger 66 is released.

A push lever 68 is attached to the nose unit 35. The push lever 68 is movable to/from the nose unit 35 in the direction of the center line A1. As shown in FIG. 1, an elastic member 74 that biases the push lever 68 in the direction of the center line A1 is arranged.

The elastic member 74 is a metallic compression coil spring, and the elastic member 74 biases the push lever 68 in a direction in which the push lever 68 goes away from the bumper 33. A stopper 86 is arranged in the nose unit 35 so that the push lever 68 that is biased by the elastic member 74 stops when being in contact with the stopper 86.

A push switch 69 shown in FIG. 4 is arranged in the nose unit 35. The push switch 69 is turned ON when the push lever 68 is pressed against the workpiece to be driven 70. The push switch 69 is turned OFF when the push lever 68 is away from the workpiece to be driven 70.

A main switch 81 shown in FIG. 4 is arranged in the housing 11. The main switch 81 is arranged in the connecting unit 20 or the handle 18. The operator operates the main switch 81. If the operator turns ON the main switch 81 when the storage battery 40 is attached to the connecting unit 20, a voltage of the storage battery 40 is applied to the microcomputer 63, so that the microcomputer 63 is activated. When the operator turns OFF the main switch 81, the microcomputer 63 stops. After the main switch 81 is turned ON, if the driving operation operated by the operator is not detected for a certain period of time, that is, if signals from the trigger switch 67 and the push switch 69 are not detected for a certain period of time, the microcomputer 63 automatically turns OFF the main switch 81.

A position detection sensor 72 that detects a rotational state of the pin wheel 49, that is, a rotational angle thereof is arranged. The position detection sensor 72 is arranged in the tale unit 31. A permanent magnet 82 is attached to the pin wheel 49. The position detection sensor 72 outputs a signal in accordance with an intensity of a magnetic field formed by the permanent magnet 82. The position detection sensor 72 is away from the permanent magnet 82. The position detection sensor 72 is a contactless magnetic sensor.

A phase detection sensor 83 shown in FIG. 4 is arranged inside the motor storage 19. The phase detection sensor 83 detects a position of the motor shaft 37 in the rotational direction, that is, a phase thereof, and outputs its signal. A permanent magnet is attached to the motor shaft 37. The phase detection sensor 83 is a magnetic sensor. The phase detection sensor 83 outputs a signal in accordance with an intensity of a magnetic field formed by the permanent magnet.

Further, a temperature detection sensor 80 shown in FIG. 4 is arranged. The temperature detection sensor 80 detects a temperature of the storage battery 40 or an inner temperature of the housing 11, and outputs its signal. A storage-battery detection sensor 84 is arranged in the connecting unit 20. The storage-battery detection sensor 84 detects whether the storage battery 40 is present or not, and outputs its signal. Further, a voltage detection sensor 85 and a current-value detection sensor 87 are arranged. The voltage detection sensor 85 detects a voltage between the storage battery and the inverter circuit 61, and outs its signal. The current-value detection sensor 87 detects a current value between the storage battery 40 and the inverter circuit 61, and outs its signal. Further, a striking-unit positional sensor 88 is arranged in the nose unit 35. The striking-unit positional sensor 88 detects a position of the striking unit 12 in the direction of the center line A1, and outs its signal.

As shown in FIG. 2, a display unit 71 is arranged in the connecting unit 20. The display unit 71 includes, for example, a light emitting diode (LED) lamp, a light emitting diode display, and a liquid crystal panel. The display unit 71 displays states of the driver 10, such as a usable mode of the driver 10, a limitation mode thereof and the voltage of the storage battery 40. The display unit 71 is exposed to outside from the connecting unit 20, and the operator can visually check the display unit 71. Note that the main switch 81 may be arranged in the display unit 71.

The microcomputer 63 processes a signal of the trigger switch 67, a signal of the push switch 69, a signal of the main switch 81, a signal of the voltage detection sensor 85, a signal of the temperature detection sensor 80, a signal of the position detection sensor 72, a signal of the phase detection sensor 83, a signal of the storage-battery detection sensor 84, a signal of the current-value detection sensor 87, and a signal of the striking-unit positional sensor 88 to control the inverter circuit 61 and the display unit 71.

A usage example of the driver 10 will be described. When the operator attaches the storage battery 40 to the connecting unit 20, and then, when the operator turns ON the main switch 81, the microcomputer 63 is activated. When at least either the turning OFF of the trigger switch 67 or the turning OFF of the push switch 69 is detected, the microcomputer 63 stops the electric motor 15.

When the electric motor 15 stops, the pin 77A of the pinion 77 and the convex portion 26A of the rack 26 engage with each other as shown in FIG. 3, and the piston 24 stops while being away from the bumper 33. That is, the piston 24 stops at the idle position. The idle position is between the top dead point and the bottom dead point in the direction of the center line A1. In FIGS. 1 and 3, the top dead point of the piston 24 is a position at which the piston 24 is the closest to the pressure chamber 13 in the direction of the center line A1. The bottom dead point of the piston 24 is a position at which the piston 24 is pressed against the bumper 33 as shown in FIG. 1.

When the piston 24 stops at the idle position as shown in FIG. 3, an end 25A of the driver blade 25 is positioned between a head 58A of the nail 58 and an end 35A of the nose unit 35 in the direction of the center line A1. When the piston 24 stops at the idle position while the push lever 68 is away from the workpiece to be driven 70, the push lever 68 stops while being in contact with the stopper 86.

The microcomputer 63 detects that the piston 24 is at the idle position on the basis of the signal output from the position detection sensor 72, and the microcomputer 63 stops the electric motor 15. When the electric motor 15 stops, the rotational control mechanism 51 holds the piston 24 at the idle position.

The piston 24 and the driver blade 25 receive a bias force in accordance with a pneumatic pressure of the pressure chamber 13, and the bias force that has been received on the driver blade 25 is transmitted to the pin wheel shaft 48 through the pin wheel 49.

When the pin wheel shaft 48 receives a clockwise torque as shown in FIG. 3, the rotational control mechanism 51 receives the torque and prevents the rotation of the pin wheel shaft 48. In this manner, the electric motor 15 stops while the pin wheel 49 stops, and the piston 24 stops at the idle position in FIG. 3.

When the trigger switch 67 is turned ON while the push switch 69 is turned ON, the microcomputer 63 repeats the control for turning ON and OFF the switch element of the inverter circuit 61 to supply the power of the storage battery 40 to the electric motor 15. Then, the motor shaft 37 of the electric motor 15 rotates. A torque of the motor shaft 37 is transmitted to the pin wheel shaft 48 through the speed reducer 43.

The rotational directions of the motor shaft 37 and the output member 45 are the same as each other. When the output member 45 rotates, a torque of the output member 45 is transmitted to the pin wheel 49, and the pin wheel 49 rotates counterclockwise in FIG. 3. When the pin wheel 49 rotates counterclockwise in FIG. 3, the torque of the pin wheel 49 is transmitted to the driver blade 25 and the piston 24, so that the piston 24 moves in the second direction B2 so as to come close to the pressure chamber 13 in the direction of the center line A1. That is, the piston 24 rises to be against the pneumatic pressure of the pressure chamber 13 from the idle position toward the top dead point. When the piston 24 rises from the idle position, the pneumatic pressure of the pressure chamber 13 increases.

When the piston 24 arrives at the top dead point, the end 25A of the driver blade 25 is positioned to be upper than the head 58A of the nail 58. Also, when the piston 24 arrives at the top dead point, the pin 77A of the pinion 77 is released from the convex portion 26A of the rack 26. Therefore, the striking unit 12 is moved toward the bottom dead point in the first direction B1, that is, is dropped by the pneumatic pressure of the pressure chamber 13. When the striking unit 12 is dropped, the driver blade 25 strikes the head 58A of the nail 58 in the injection path 36, so that the nail 58 is driven into the workpiece to be driven 70.

When an entire body of the nail 58 is wedged into the workpiece to be driven 70 and the nail 58 stops, the end 25A of the driver blade 25 is brought away from the head 58A of the nail 58 by its reactive force. The piston 24 collides with the bumper 33, and the bumper 33 elastically deforms, so that kinetic energy of the piston 24 and the driver blade 25 is absorbed.

The motor shaft 37 of the electric motor 15 rotates even after the driver blade 25 strikes the nail 58. Then, when the pin 77A of the pinion 77 engages with the convex portion 26A of the rack 26, the piston 24 rises again in FIG. 1 because of the torque of the pin wheel 49. The microcomputer 63 detects the position of the pin wheel 49 even after the driving of the nail 58. When the microcomputer 63 detects that the piston 24 moves from the position of the pin wheel 49 and arrives at the idle position in FIG. 3, the microcomputer 63 stops the electric motor 15. That is, the pin wheel 49 stops, and the rotational control mechanism 51 holds the piston 24 at the idle position.

When using the driver 10, the operator selects either a continuous shot mode or a single shot mode. In the continuous shot mode, regardless of an operational order of the trigger 66 and the push lever 68, the nail 58 can be driven into the workpiece to be driven 70 by the first operation or the second operation. In the first operation, the nail 58 is driven into the workpiece to be driven 70 by alternately repeating an operation of pressing the push lever 68 against the workpiece to be driven 70 while an operational force is applied to the trigger 66 and an operation of bringing the push lever 68 to be away from the workpiece to be driven 70. In the second operation, the nail 58 is driven into the workpiece to be driven 70 by alternately repeating an operation of applying the operational force to the trigger 66 while the push lever 68 is pressed against the workpiece to be driven 70 and an operation of releasing the operational force from the trigger 66.

An operation is performed in the single shot mode, the operation applying the operational force to the trigger 66 to drive the nail 58 into workpiece to be driven 70 after pressing the push lever 68 against the workpiece to be driven 70, and then, releasing the operational force from the trigger 66 and bringing the push lever 68 to be away from the workpiece to be driven 70.

For example, types of a movement state at the time of the striking of one nail 58 by the striking unit 12 in the selection of the continuous shot mode, such as types of an aspect of recognition of the operational time, include a first recognition aspect and a second recognition aspect. In the first recognition aspect, elapsed time that is taken from a moment of start of the rising of the piston 24 that has stopped at the idle position through a moment of the dropping and the arrival of the piston 24 at the bottom dead point to a moment of the arrival of the piston 24 at the idle position is recognized as the operational time. In the second recognition aspect, time taken for the movement of the driver blade 25 from the start position of the striking of the nail 58 by the driver blade 25 to the end position of the striking of the nail 58 by the driver blade 25 is recognized as the operational time. In this case, the position of the driver blade 25 is detected by the position detection sensor 88 arranged in vicinity of the injection path 36 of the nose unit 35.

The operational time taken for the driving of the nail 58 by the striking unit 12 varies in accordance with a performance of the storage battery 40. In accordance with the performance of the storage battery 40, the microcomputer 63 can limit and permit the selections of the single shot mode and the continuous shot mode.

Figure 5:
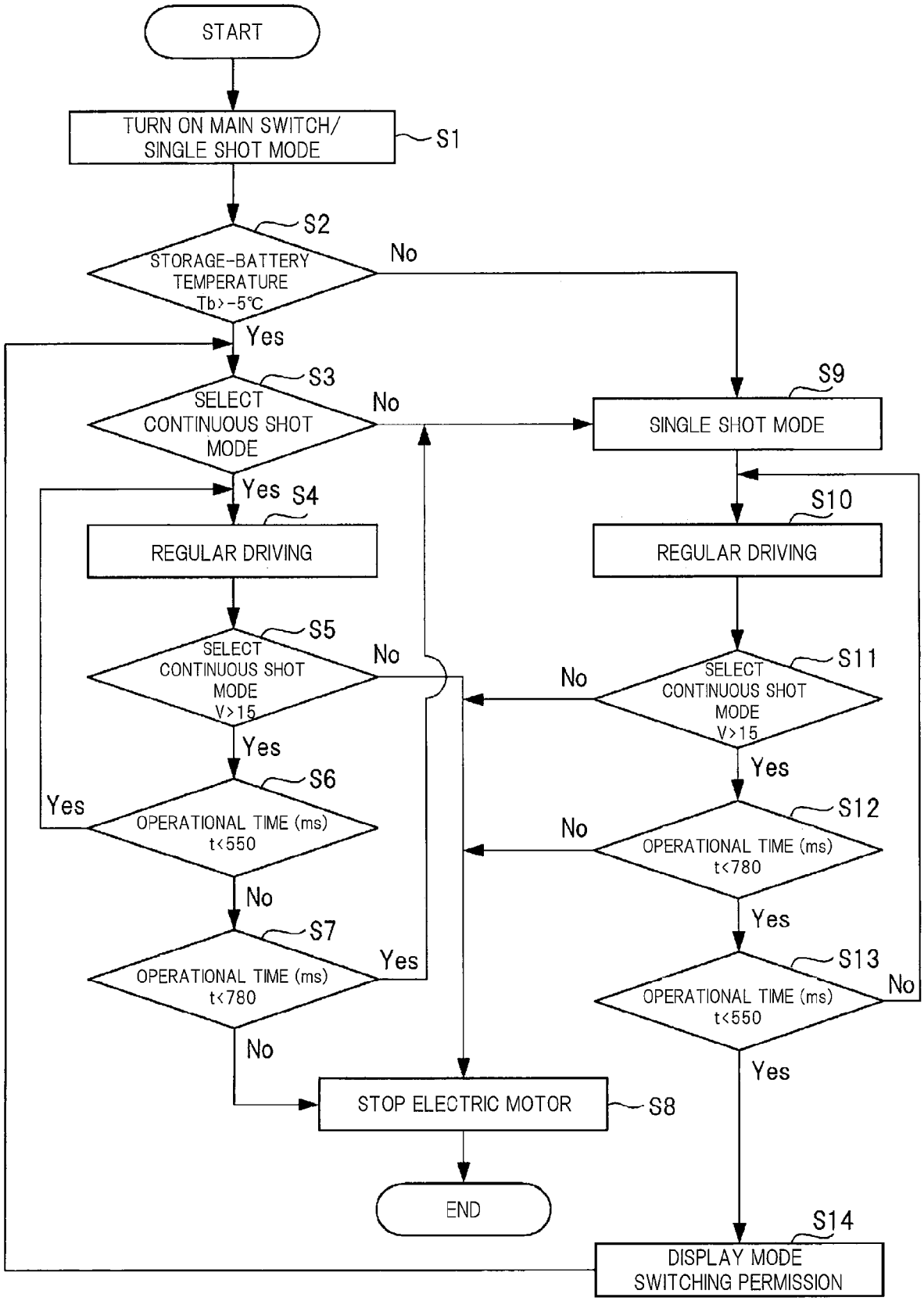
FIG. 5 is a flowchart showing a control example of the driver.

An example of the control performed by the microcomputer 63 is shown in a flowchart of FIG. 5. When the operator turns ON the main switch 81 at a step S1, the microcomputer 63 is activated. When the microcomputer 63 is activated, the single shot mode is set regardless of previous mode selection. At a step S2, the microcomputer 63 determines whether a temperature "Tb" of the storage battery 40 is higher than a predetermined temperature or not. The predetermined temperature has an experimental value or a value that is simulated on the basis of a discharge property of the storage battery 40.

A technical implication of the predetermined temperature is a criteria for determining whether the driving operation of the nail 58 is completed or not within predetermined time taken from the moment of the start of the movement of the striking unit 12 from the idle position. The predetermined temperature is set to, for example, −5° C. When the temperature of the storage battery 40 exceeds the predetermined temperature, the discharge property of the storage battery 40 is favorable. That is, even if either the continuous shot mode or the single shot mode is selected, the workmanship at the time of the driving of the nail 58 into the workpiece to be driven 70 can be favorably maintained.

On the other hand, when the temperature of the storage battery 40 is equal to or lower than the predetermined temperature, the discharge property of the storage battery 40 reduces. That is, the following operation is performed induration from the first driving operation to a next driving operation as performed in the single shot mode, and therefore, the operation time is long. Specifically, the operation time taken from the first driving operation to the next driving operation is long so that the nail 58 is driven into the workpiece to be driven 70 by applying the operation force to the trigger 66 after the push lever 68 is pressed against the workpiece to be driven 70, and then, the operational force on the trigger 66 is released while the push lever 68 is brought away from the workpiece to be driven 70, then, the push lever 68 is pressed against the workpiece to be driven 70 again, and then, the operational force is applied to the trigger 66.

In this case, even if the operational time of the striking unit 12 becomes long due to the reduction in the discharge property of the storage battery 40, the workmanship at the time of the driving of the nail 58 into the workpiece to be driven 70 is not reduced by the reduction in the discharge property of the storage battery 40. And, even if the workmanship at the time of the driving of the nail 58 into the workpiece to be driven 70 is reduced by the reduction in the discharge property of the storage battery 40, a degree of the reduction in the workmanship is relatively small, and is nearly ignorable for the operator.

On the other hand, the operational time taken from the first driving operation to the next driving operation as performed in the continuous shot mode is shorter than the operational time in the single shot mode. Specifically, the operational time taken for the first operation in the continuous shot mode is short, that is, the operational time being taken from the moment of the striking of the nail 58 into the workpiece to be driven 70 by applying the operational force to the trigger 66 and pressing the push lever 68 against the workpiece to be driven 70 through the moment at which the push lever 68 is brought away from the workpiece to be driven 70 to the moment of the pressing of the push lever 68 against the workpiece to be driven 70 again is short. And, the operational time taken for the second operation in the continuous shot mode is short, that is, the operational time being taken from the moment of the striking of the nail 58 into the workpiece to be driven 70 by applying the operational force to the trigger 66 and pressing the push lever 68 against the workpiece to be driven 70 through the moment at which the operational force on the trigger 66 is released while the push lever 68 is moved while being pressed against the workpiece to be driven 70 to the moment of the application of the operational force to the trigger 66 again is short.

In the case of the short operational time taken from the first driving operation to the next driving operation as described above, when the operational time of the striking unit 12 becomes long due to the reduction in the discharge property of the storage battery 40, even if the operation of the driver 10 shifts from the first driving operation to the next driving operation, the next driving operation of the nail 58 by the driver 10 is not completed yet, and therefore, the workmanship at the time of the driving of the nail 58 into the workpiece to be driven 70 is reduced.

When determining "YES" at the step S2, the microcomputer 63 determines whether the operator is selecting the continuous shot mode or not at a step S3. When determining "YES" at the step S3, the microcomputer 63 performs the regular driving operation corresponding to the continuous shot mode at a step S4.

At a step S5, the microcomputer 63 determines whether a voltage "V" of the storage battery 40 exceeds a predetermined voltage or not. When a rated voltage of the storage battery 40 is 18 V, and besides, when the storage battery is chargeable up to 21 V at a maximum, the predetermined voltage is exemplified as 15 V. When determining "YES" at the step S5, the microcomputer 63 determines whether the operational time "t" taken for the driving of the nail 58 by the striking unit 12 is less than first predetermined time or not at a step S6. The microcomputer 63 acquires the operational time "t" by processing the signal of the position detection sensor 72.

The first predetermined time has a value that is set so as to achieve the completion of the driving of the nail 58 before the push lever 68 is away from the workpiece to be driven 70 at the time of the driving of the nail 58 in the continuous shot mode. As one example of the first predetermined time, 550 ms can be used. When determining "YES" at the step S6, the microcomputer 63 advances the process to the step S4.

When determining "NO" at the step S6, the microcomputer 63 determines whether the operational time "t" is less than second predetermined time or not at a step S7. A value of the second predetermined time is larger than a value of the first predetermined time. The second predetermined time has a value that is set so as to achieve the completion of the driving of the nail 58 before the push lever 68 is away from the workpiece to be driven 70 at the time of the driving in the single shot mode. As one example of the second predetermined time, 780 ms can be used. When determining "No" at the step S7, the microcomputer 63 stops the electric motor 15 and causes the display unit 71 to display a message indicating that "the usage of the driver 10 stops" at a step S8, and then, ends the control of FIG. 5. That is, at the step S8, the microcomputer 63 limits, more specifically, prohibits both the single shot mode and the continuous shot mode.

When determining "No" at the step S2 or the step S3, the microcomputer 63 advances the process to a step S9 to permit the single shot mode and prohibits the continuous shot mode. That is, while the electric motor 15 rotates when the operator selects the single shot mode, the electric motor 15 stops even when the operator selects the continuous shot mode. When determining "No" at the step S2 or the step S3 and advancing the process to the step S9, the microcomputer 63 permits the single shot mode, and causes the display unit 71 to display that the continuous shot mode is prohibited. Incidentally, even when the microcomputer 63 determines "No" at the step S3 and advances the process to the step S9, the continuous shot mode is not prohibited.

At a step S10 following the step S9, the microcomputer 63 performs the regular driving operation corresponding to the single shot mode. At a step S11 following the step S10, the microcomputer 63 determines whether the voltage "V" of the storage battery 40 exceeds the predetermined voltage that is 15 V. When determining "No" at the step S11 or the step S5, the microcomputer 63 advances the process to the step S8.

When determining "Yes" at the step S11, the microcomputer 63 determines whether the operational time "t" is less than the second predetermined time that is 780 ms or not at a step S12. When determining "No" at the step S12, the microcomputer 63 advances the process to the step S8. When determining "Yes" at the step S12, the microcomputer 63 advances the process to a step S13, and determines whether the operational time "t" is the first predetermined time that is 550 ms or not.

When determining "No" at the step S13, the microcomputer 63 advances the process to the step S10. When determining "Yes" at the step S13, the microcomputer 63 advances the process to a step S14 to cancel the limitation of the continuous shot mode, and advances the process to the step S3. At the step S3, the microcomputer 63 causes the display unit 71 to display a message indicating that "the shot mode can be switched from the single shot mode to the continuous shot mode."

As described above, in the control example of FIG. 5, the microcomputer 63 determines the temperature "Tb" of the storage battery 40 and the voltage "V" and the operational time "t" of the storage battery 40, and determines the limitation, the permission and the limitation cancel of the continuous shot mode or the single shot mode on the basis of its determination result. Therefore, when the operator drives the nail 58 into the workpiece to be driven 70 by using the driver 10, the operator can select a suitable usage mode of the driver 10 for the performance of the storage battery 40. Specifically, even when either the continuous shot mode or the single shot mode is selected, the driving operation of the nail 58 into the workpiece to be driven 70 can be completed before the driver 10 is away from the workpiece to be driven 70. Therefore, the workmanship at the time of the driving of the nail 58 in to the workpiece to be driven 70 can be favorably maintained. The favorable workmanship at the time of the driving of the nail 58 in to the workpiece to be driven 70 implies that the head 58A of the nail 58 does not protrude out of a surface of the workpiece to be driven 70.

When determining that a state of the performance of the storage battery 40 is not suitable for both the continuous shot mode and the single shot mode, the microcomputer 63 can cause the display unit 71 to display its determination result, and make the operator recognize the state.

Note that an execution timing of the determination step for at least one condition of the temperature "Tb" of the storage battery 40 and the voltage "V" and the operational time "t" of the storage battery 40 may be switched to an execution timing or a determination timing of another step. The microcomputer 63 may determine at least one condition of the temperature "Tb" of the storage battery 40 and the voltage "V" and the operational time "t" of the storage battery 40 shown in FIG. 5, and determine the limitation and the permission for the continuous shot mode or the single shot mode on the basis of its determination result.

Figure 6:
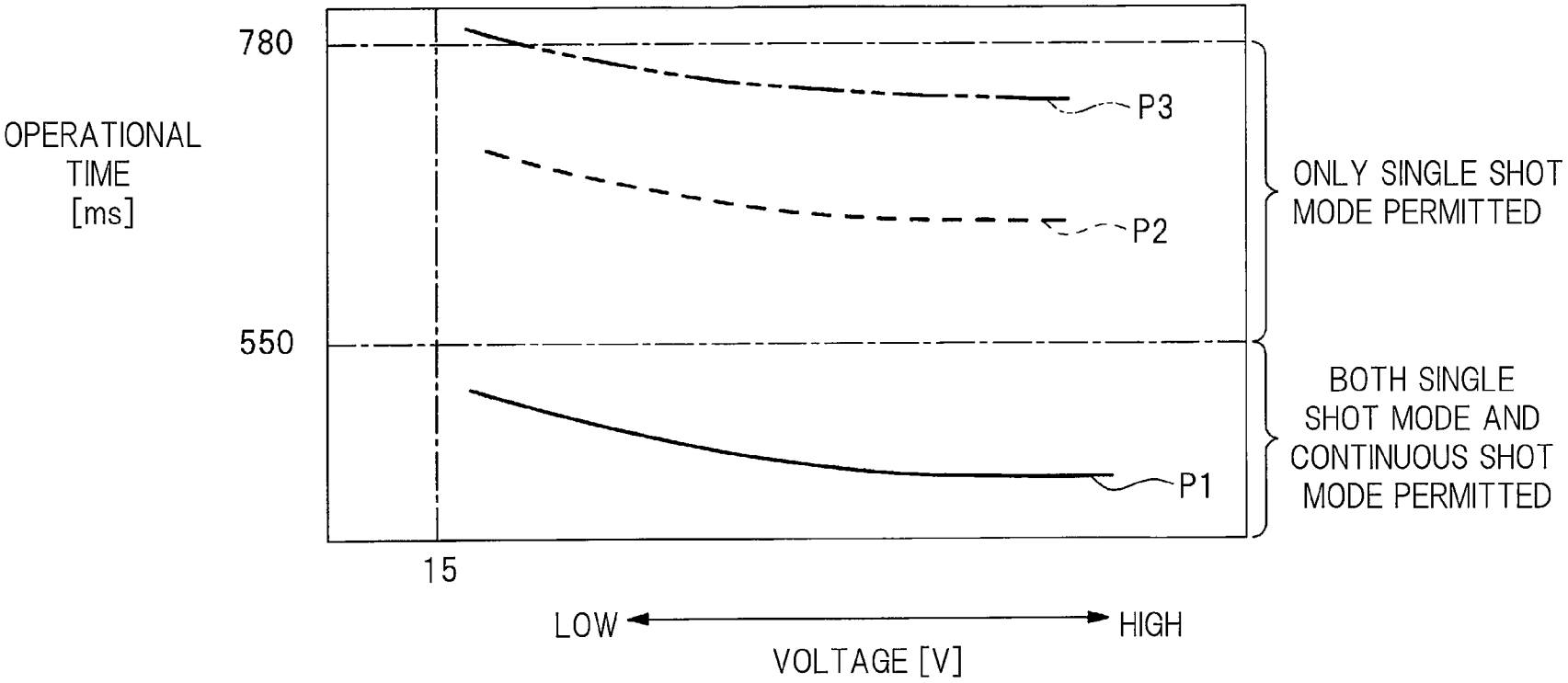
FIG. 6 is a map showing one example of a relation between a performance of a storage battery used for the driver and a permitted mode.

FIG. 6 is a map showing one example of a relation between the performance of the storage battery 40 and the usage mode of the driver 10. A performance "P1" shown by a solid line shows that both the continuous shot mode and the single shot mode are permitted if the temperature of the storage battery 40 is an ordinary temperature such as 10° C. exceeding −5° C. while the operational time "t" is less than the first predetermined time that is 550 ms when the voltage "V" of the storage battery 40 exceeds the predetermined voltage that is 15 V.

A performance "P2" shown by a dashed line shows that only the single shot mode is permitted if the temperature of the storage battery 40 is −5° C. while the operational time "t" is equal to or longer than the first predetermined time that is 550 ms but shorter than the second predetermined time that is 780 ms when the voltage "V" of the storage battery 40 exceeds the predetermined voltage that is 15 V (in some embodiments, performance "P2" is considered as an abnormal state).

A performance "P3" shown by a chain double-dashed line shows that only the single shot mode is permitted if the temperature of the storage battery 40 is −10° C. while the operational time "t" is equal to or longer than the first predetermined time that is 550 ms but shorter than the second predetermined time that is 780 ms when the voltage "V" of the storage battery 40 exceeds the predetermined voltage that is 15 V (in some embodiments, performance "P3" is considered as an abnormal state).

Figure 7:
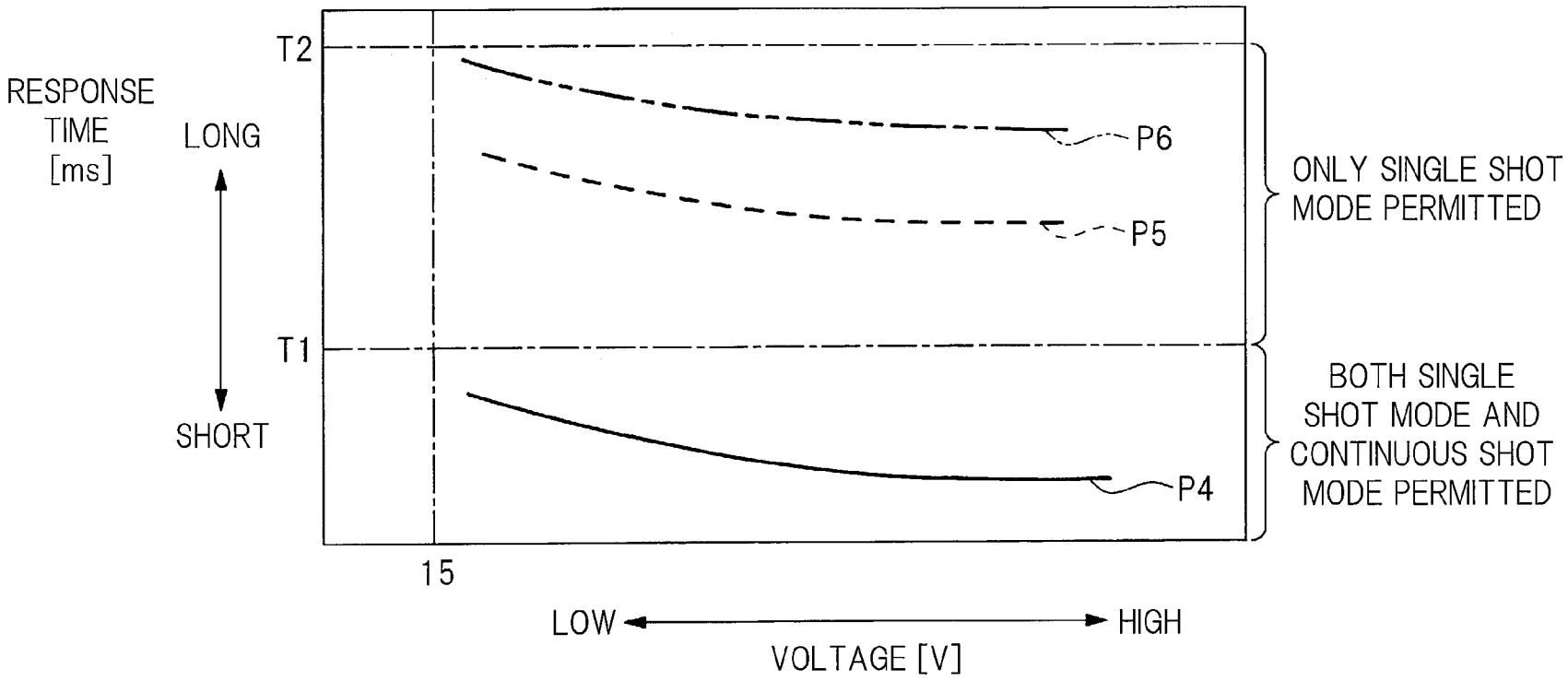
FIG. 7 is a map showing another example of the relation between the performance of the storage battery used for the driver and the permitted mode.

FIG. 7 is a map showing one example of a relation between the performance of the storage battery 40 and the usage mode of the driver 10. Response time shown on a horizontal axis of FIG. 7 can be recognized as elapsed time taken from the moment of the start of the rising of the striking unit 12 from the idle position to the moment of the completion of the driving of the nail 58 into the workpiece to be driven 70. The completion of the driving of the nail 58 implies that the head 58A of the nail 58 is wedged into the workpiece to be driven 70. The response time can be also recognized as time taken from the moment of the start of the rising of the striking unit 12 from the idle position to the moment of the arrival at the top dead point.

The response time can be estimated from the signal of the voltage detection sensor 85, the signal of the striking-unit positional sensor 88 or others. In the single shot mode, the rising of the striking unit 12 starts from the idle position when the trigger 66 is operated in the state of the pressing of the push lever 68 against the workpiece to be driven 70. In the continuous shot mode, the rising of the striking unit 12 starts from the idle position when the push lever 68 is pressed against the workpiece to be driven 70 in the state of the operation of the trigger 66.

A performance "P4" shown by a solid line shows that both the continuous shot mode and the single shot mode are permitted if the temperature of the storage battery 40 is an ordinary temperature such as 10° C. exceeding −5° C. while the response time is shorter than the third predetermined time that is "T1" when the voltage "V" of the storage battery 40 exceeds the predetermined voltage that is 15 V.

A performance "P5" shown by a dashed line shows that only the single shot mode is permitted if the temperature of the storage battery 40 is −5° C. while the response time is equal to or longer than the third predetermined time that is "T1" but shorter than the fourth predetermined time that is "T2" when the voltage "V" of the storage battery 40 exceeds the predetermined voltage that is 15 V.

A performance "P6" shown by a chain double-dashed line shows that only the single shot mode is permitted if the temperature of the storage battery 40 is −10° C. while the response time is equal to or longer than the third predetermined time that is "T1" but shorter than the fourth predetermined time that is "T2" when the voltage "V" of the storage battery 40 exceeds the predetermined voltage that is 15 V. Note that the response time shown in the map of FIG. 7 is on the presumption that lengths of the nails 58 should be the same as one another.

The microcomputer 63 can determine the performance of the storage battery 40 on the basis of conditions not shown in the control example of FIG. 5, the map of FIG. 6 and the map of FIG. 7. For example, the microcomputer 63 can determine the performance of the storage battery 40 from a current value of the storage battery 40, and limit and permit each of the continuous shot mode and the single shot mode on the basis of its determination result. The microcomputer 63 can directly detect the temperature of the storage battery 40, and besides, indirectly determine the performance of the storage battery 40 from a temperature inside the housing 11, and limit and permit each of the continuous shot mode and the single shot mode on the basis of its determination result. Alternatively, the microcomputer 63 can determine the performance of the storage battery 40 on the basis of a usage history of the storage battery 40 such as the number of times of the driving of the nail 58 and the number of times of the attachment/detachment of the storage battery 40 to/from the connecting unit 20, and limit and permit each of the continuous shot mode and the single shot mode on the basis of its determination result. The number of times of the driving of the nail 58 can be determined from the signal of the position detection sensor 72 or the signal of the phase detection sensor 83. The number of times of the attachment/detachment of the storage battery 40 to/from the connecting unit 20 can be determined from the signal of the storage-battery detection sensor 84.

In both cases before and after the driving of the nail 58, the microcomputer 63 can perform the limitation for the continuous shot mode, the limitation for the continuous shot mode but the permission for the single shot mode, the limitation for both the continuous shot mode and the single shot mode, and the cancellation of the limitation for the mode. The case before the driving of the nail 58 includes a case in which the operator does not operate the trigger 66 while the push lever 68 is away from the workpiece to be driven 70.

The microcomputer 63 can cause the display unit 71 to display the limitation for the mode and the cancellation of the limitation for the mode in both cases before and after the driving of the nail 58.

In various controls before the driving of the nail 58, the microcomputer 63 processes the signals of various sensors and switches to estimate the performance of the storage battery 40 or the operational time for the driving of the nail 58 by the striking unit 12 on the basis of the conditions such as the temperature of the storage battery 40, the voltage of the storage battery 40, the current value of the storage battery 40, and the usage history of the storage battery 40.

The technical implication of the matters described in the embodiment is as follows. The pressure chamber 13 is one example of the first bias unit, and the trigger 66 is one example of the first operational unit. The push lever 68 is one example of the second operational unit, and the microcomputer 63 is one example of each of the control unit, the first determination unit, the second determination unit, the third determination unit or the fourth determination unit. Each of the storage battery 40, the electric motor 15 and the power transmission mechanism 14 is one example of the second bias unit. The single shot mode is the first driving mode, and the continuous shot mode is the second driving mode. The limitation for the continuous shot mode by the microcomputer 63 is the limitation mode. The position of the striking unit 12 caused when the piston 24 is at the idle position is the predetermined position. The nail 58 is one example of the fastener.

The driver is not limited to the foregoing embodiments, and various alterations can be made within the scope of the present invention. For example, a bellows and the piston are connected to each other, and the pressure chamber can be formed inside the bellows. Types of the first bias unit include the one that moves the striking unit in the first direction by using a bias force of the elastic member. Types of the elastic member include a metallic spring and a synthetic rubber. Types of the second bias unit include not only the rack-and-pinion mechanism but also a cam mechanism and a traction mechanism. The traction mechanism has a motor, a wire, a drum to which a torque of the motor is transmitted, and a clutch mechanism. The wire is connected to the striking unit and is wound around the drum. The clutch mechanism connects and disconnects a power transmission path between the motor and the drum. When the wire is wound around the drum in traction by the torque of the motor, the striking unit moves in the second direction. When the clutch disconnects the power transmission path, the striking unit is moved in the first direction by the first bias unit.

The first operational unit is a component that is operated by the operator, types of which include a trigger, a lever, a button and a panel. Types of the first operational unit include the one that reciprocates, the one that rotationally moves, and the one that does not move. Types of the second operational unit include a lever, a shaft, a rod and an arm. The types of the second operational unit includes a component that moves while being pressed against the workpiece to be driven or a component that does not move. The pressing of the second operational unit against the workpiece to be driven can be also detected by a pressure sensor.

Types of the driver of the present embodiment include the one having the bottom dead point or the one having the top dead point as the idle position of the striking unit. Even in the driver having either structure, the operational time taken for the movement from the bottom dead point to the idle position after the striking unit strikes the fastener varies depending on a performance of the power supply.

Types of at least one component of the control unit, the first control unit, the second control unit, the third control unit and the fourth control unit include a processor, a circuit, a memory device, a module and a unit. Types of the motor that moves the striking unit from the second position to the first position include not only the electric motor but also a hydraulic motor and a pneumatic motor. The electric motor may be either a brushed motor or a brushless motor. The power supply of the electric motor may be either a direct-current power supply or an alternate-current power supply. Types of the power supply include the one that is detachable to the housing and the one that is connected to the housing through a power cable.

Note that the section of the explanation with reference to FIG. 3 describes that the pin wheel 49 rotates counterclockwise. This definition is made for convenience in order to explain the rotational direction of the pin wheel 49 while the driver 10 is viewed from a front side in FIG. 3. Types of the workpiece to be driven 70 include a floor, a wall, a ceiling, a column and a roof. Types of a material of the workpiece to be driven 70 include wood, concrete and gypsum. Types of the fastener include not only a rod-shaped nail but also a U-shaped tacker.

EXPLANATION OF REFERENCE CHARACTERS

10 . . . driver, 12 . . . driving unit, 13 . . . pressure chamber, 14 . . . power transmission mechanism, 15 . . . electric motor, 40 . . . storage battery, 58 . . . nail, 63 . . . microcomputer, 66 . . . trigger, 68 . . . push lever, 71 . . . display unit, B1 . . . first direction, B2 . . . second direction

The invention claimed is:

1. A driver comprising:

a striking unit configured to be movable in a first direction and a second direction that is opposite to the first direction;

a first bias unit configured to move the striking unit in the first direction so that a fastener is struck by the striking unit;

a first operational unit configured to be operated by an operator;

a second operational unit configured to be pressed against a workpiece to which the fastener is struck; and a control unit configured to move the striking unit in the first direction by using the first bias unit when the control unit detects the operation of the first operational unit and the pressing of the second operational unit against the workpiece, wherein the control unit is configured to control the driver in a first driving mode or a second driving mode in response to selection by the operator, wherein the control unit is configured to execute, the first driving mode causing the striking unit to perform a single driving operation when the control unit detects both the operation of the first operational unit and the operation of the second operational unit, and the second driving mode causing the striking unit to perform a driving operation every time when the second operational unit is operated while the first operational unit remains operated by the operator, and wherein the control unit further includes a limitation mode in which;

(1) after a driving operation in response to operation of the second operational unit in the second driving mode, the control unit terminates the second driving mode; or (2) the control unit maintains the first driving mode that is automatically selected when the driver is activated, without allowing the operator to select the second mode.

2. The driver according to claim 1, wherein the control unit automatically selects the limitation mode when determining an abnormal state.

3. The driver according to claim 2, wherein a second bias unit configured to move the striking unit in the second direction is arranged, the control unit is configured to move the striking unit stopping at a predetermined position in the second direction by using the second bias unit, and then, to move the striking unit in the first direction by using the first bias unit so that the fastener is struck by the striking unit, and besides, to move the striking unit in the second direction by using the second bias unit to return the striking unit to the predetermined position, and the control unit determines the abnormal state on the basis of operational time taken from a moment of start of the movement of the striking unit stopping at the predetermined position in the second direction through a moment of the striking of the fastener by the striking unit to a moment of the movement of the striking unit in the second direction and arrival of the striking unit at the predetermined position.

4. The driver according to claim 2, further comprising a second bias unit configured to move the striking unit in the second direction, wherein the second bias unit has:

an electric motor configured to be rotated by supply of power thereto;

a power supply configured to supply the power to the electric motor; and a power transmission mechanism configured to move the striking unit in the second direction by using a torque of the electric motor.

5. The driver according to claim 4, wherein the power supply is a storage battery, and the control unit determines the abnormal state on the basis of a voltage of the storage battery.

6. The driver according to claim 4, wherein the control unit determines the abnormal state on the basis of a current value of the power supply.

7. The driver according to claim 4, wherein the control unit determines the abnormal state on the basis of a temperature of the power supply.

8. The driver according to claim 4, wherein the control unit determines the abnormal state on the basis of a usage history of the power supply.

9. The driver according to claim 1 further comprising a display unit displaying which one of the first driving mode, the second driving mode and the limitation mode is being operated.

10. A driver comprising:

a striking unit configured to be movable in a first direction and a second direction that is opposite to the first direction;

an electric motor configured to move the striking unit in the second direction by using power of a power supply;

a first bias unit configured to move the striking unit in the first direction so that a fastener is struck by the striking unit;

a first operational unit configured to be operated by an operator;

a second operational unit configured to be operated by the operator and pressed against a workpiece to which the fastener is struck; and a control unit configured to move the striking unit in the first direction by using the first bias unit when the control unit detects the operation of the first operational unit and the pressing of the second operational unit against the workpiece, wherein the control unit can execute;

a first driving mode performing a driving operation moving the striking unit in the first direction by using the first bias unit when the control unit detects the operation of the first operational unit after the pressing of the second operational unit against the workpiece, and a second driving mode performing a driving operation moving the striking unit in the first direction by using the first bias unit so that the fastener is struck when the control unit detects the operation of the first operational unit and the pressing of the second operational unit against the workpiece, and wherein the control unit monitors a state of the power supply, and when determining that the power supply is in an abnormal state, the control unit prohibits the driving operation in the second driving mode selected by the operator and permits the driving operation in the first driving mode selected by the operator.

11. A driver comprising:

a striking unit configured to be movable in a first direction and a second direction that is opposite to the first direction;

an electric motor;

a power transmission mechanism configured to convert a torque of the motor into a moving force of the striking unit;

a battery configured to supply the power to the motor;

a first operational unit configured to be operated by an operator;

a second operational unit configured to be pressed against a workpiece to which the fastener is struck; and a control unit configured to control the motor, wherein, by an operation of the operator, the control unit can execute;

a first driving mode performing a driving operation moving the striking unit in the first direction when the control unit detects the operation of the first operational unit after the pressing of the second operational unit against the workpiece, and a second driving mode performing a driving operation moving the striking unit in the first direction so that the fastener is struck when the control unit detects the operation of the first operational unit and the pressing of the second operational unit against the workpiece, and wherein the control unit monitors a state of the battery, and when determining that the battery is in an abnormal state, the control unit prohibits the driving operation in the second driving mode selected by the operator and permits the driving operation in the first driving mode selected by the operator.

12. A driver comprising:

a striking unit configured to be movable in a first direction and a second direction that is opposite to the first direction;

a first bias unit configured to move the striking unit in the first direction so that a fastener is struck by the striking unit;

a first operational unit configured to be operated by an operator;

a second operational unit configured to be pressed against a workpiece to which the fastener is struck; and a control unit configured to move the striking unit in the first direction by using the first bias unit when the control unit detects the operation of the first operational unit and the pressing of the second operational unit against the workpiece, wherein the control unit is configured to control the driver in a first driving mode or a second driving mode in response to selection by the operator, wherein the control unit is configured to execute;

the first driving mode causing the striking unit to perform a single driving operation when the control unit detects both the operation of the first operational unit and the operation of the second operational unit, and the second driving mode causing the striking unit to perform a driving operation every time when the second operational unit is operated while the first operational unit remains operated by the operator, and wherein the control unit changes the driving mode from the second driving mode to the first driving mode without the selection by the operator when detecting an abnormal state in the second driving mode.

* * * * *